United States Patent [19]

Klomp et al.

[11] Patent Number: 4,932,374

[45] Date of Patent: Jun. 12, 1990

[54] FUEL INJECTOR NOZZLE FOR INTERNAL COMBUSTION ENGINE

[75] Inventors: Edward D. Klomp, Mount Clemens; Bruce D. Peters, Rochester, both of Mich.

[73] Assignee: General Motors Corporation, Detroit, Mich.

[21] Appl. No.: 369,504

[22] Filed: Jun. 21, 1989

[51] Int. Cl.[5] ..... F02M 61/16

[52] U.S. Cl. ..... 123/298; 239/533.12; 123/299; 123/531

[58] Field of Search ..... 123/298, 299, 531; 239/222.17, 533.12

[56] References Cited

U.S. PATENT DOCUMENTS

| | | | |
|---|---|---|---|
| 3,253,584 | 5/1966 | Traub et al. | 123/299 X |
| 3,892,208 | 7/1975 | Anderson et al. | 123/299 |
| 4,421,278 | 12/1983 | Kienzle et al. | 239/533.12 |
| 4,666,088 | 5/1987 | Krauss et al. | 239/533.12 |
| 4,693,420 | 9/1987 | Klomp | 239/87 |
| 4,776,516 | 10/1988 | Klomp | 239/87 |
| 4,796,816 | 1/1989 | Khinchuk | 239/533.12 X |
| 4,834,043 | 5/1989 | Kaczynski et al. | 123/298 X |

*Primary Examiner*—Willis R. Wolfe
*Attorney, Agent, or Firm*—C. K. Veenstra

[57] ABSTRACT

Nozzle arrangements for injecting fuel into a combustion chamber of a piston engine with stratified charge being provided by a resilient diaphragm which deflects by amounts proportional to engine load. At high engine load, further deflection of the diaphragm effects a deep penetration charge for improved performance and economy. Between pulses, the diaphragm effectively closes off the nozzle so that sac volumes of the nozzle are minimized along with discharge of hydrocarbons into the combustion chamber on blowdown.

7 Claims, 2 Drawing Sheets

FIG 1
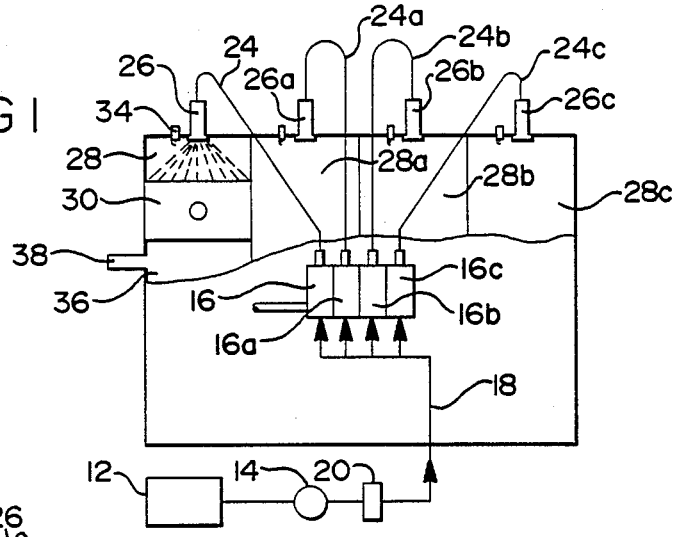
FIG 2
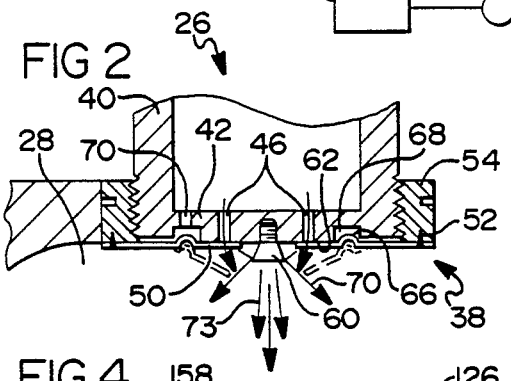
FIG 3
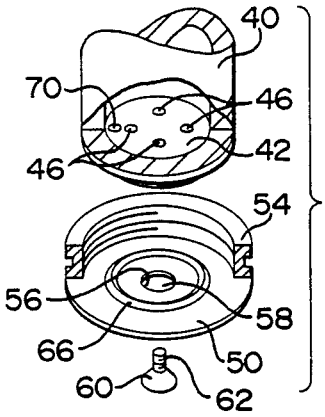
FIG 4
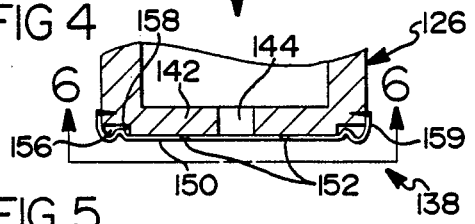
FIG 5
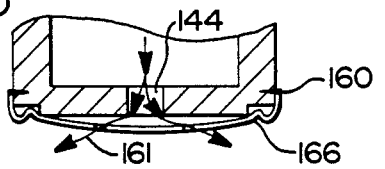
FIG 6
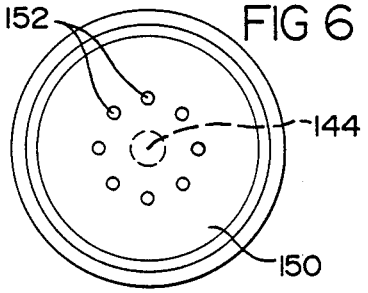
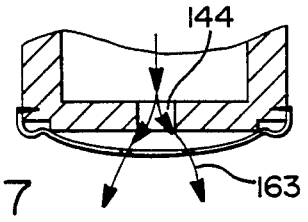
FIG 7
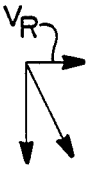
FIG 7a FIG 8
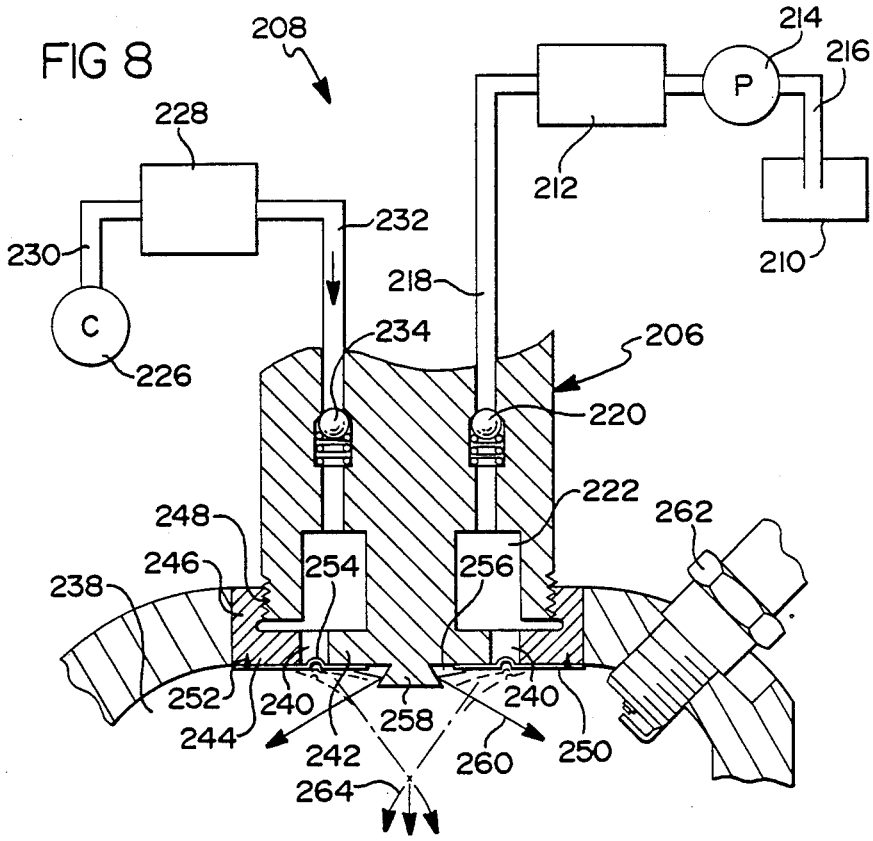
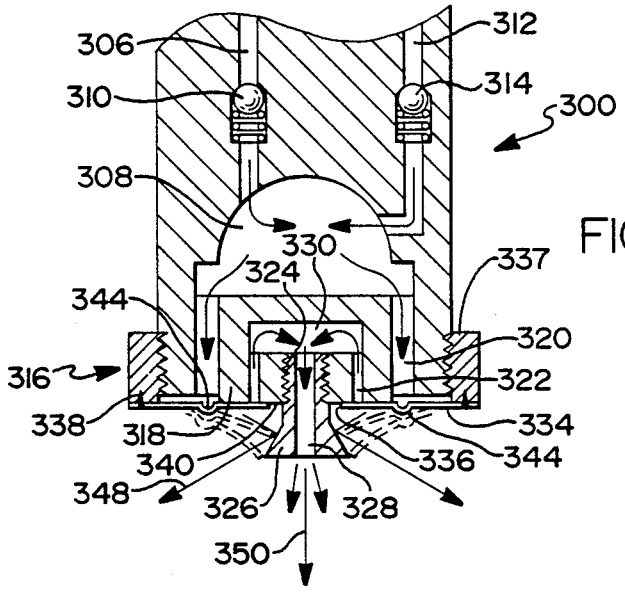
FIG 9

FUEL INJECTOR NOZZLE FOR INTERNAL COMBUSTION ENGINE

BACKGROUND OF THE INVENTION

This invention relates to the injection of fuel into internal combustion engines and more particularly to new and improved fuel injector nozzles which provide variable fuel spray depths and patterns to match varying engine loads and automatic closure of the nozzle for sealing the nozzle from combustion chamber gas intrusion between fuel injection events to provide near zero sac volume.

Various nozzle designs have been employed in fuel injection systems to provide finely atomized fuel spray patterns injected into engine combustion chambers to improve combustion and engine operation efficiency. An illustrative example of one such design is disclosed by E. F. Obert in the publication "International Combustion Engine Analysis and Practice" 2nd edition, 1950, International Textbook Company, Scranton, Pa. FIGS. 12–18, p. 386, hereby incorporated by reference. The present invention is of the general category of that disclosed in the above-referenced publication in that highly reliable in-cylinder fuel injection is provided, but further provides differing atomized fuel injection spray patterns and depths to match engine loads for optimized engine efficiency and without having significant sac volumes which generally result in undesirable high hydrocarbon emissions.

SUMMARY OF THE INVENTION

The present invention is drawn to an injector nozzle design for use in a fuel injection system in which the injection is completed early in the compression stroke for optimizing the work required to inject the fuel and, when there is an air/fuel mixture, to minimize the work to compress the air to be injected. The nozzle designs of the present invention are adaptable to be operated without air assist or to be utilized for injecting an air/fuel mixture.

In both cases, a diaphragm-type valve seals the nozzle tip from the combustion chamber, until deflected by the pressure of the fluid to be injected into the combustion chamber, to prevent the intrusion of combustion gases into the injector so that a near-zero sac volume is provided. Furthermore, with this invention, a large cone spray angle of fuel for stratified charge of the combustion chamber is provided for light engine loads such as steady state driving and subsequently, a narrow and maximum depth penetrating spray angle for filling the combustion chamber is provided for maximum loads, such as wide open throttle accelerating or climbing a steep hill for optimized engine efficiency. Between these engine loads, a wide range of fuel spray cone angles and depths of combustion chamber penetration to match varying engine loads for optimized engine performance and efficiency are obtained.

These and other features, objects and advantages of this invention will become more apparent from the following detailed description and drawing in which FIG. 1 is a diagram illustrating a fuel injection system for an internal combustion engine;

FIG. 2 is a cross-sectional view of the nozzle of one of the fuel injectors of a diagram of FIG. 1;

FIG. 3 is an exploded pictorial view of the nozzle of FIG. 2 illustrating parts thereof;

FIG. 4 is a cross-sectional view of a nozzle of an injector similar to that of FIGS. 2 and 3, but illustrating an embodiment of this invention;

FIG. 5 is a view of the embodiment of FIG. 4 showing operation of the nozzle under low load conditions;

FIG. 6 is an end view taken along lines

6—6 of FIG. 5 illustrating the diaphragm used in this invention;

FIG. 7 is a sectional view similar to that of FIG. 5 illustrating the diaphragm operation under high-load conditions;

FIG. 7A is a force diagram illustrating the feeding of fuel in the FIG. 7 construction;

FIG. 8 is a diagrammatic view of a fuel injection system illustrating another preferred embodiment of this invention, and FIG. 9 is a cross-sectional view of another embodiment of the nozzle of this invention illustrating spray angles of air/fuel mixtures injected into a combustion chamber of an internal combustion engine.

DETAILED DESCRIPTION OF THE PREFERRED EMBODIMENTS

Turning now in greater detail to the drawing, there is diagrammatically illustrated in FIG. 1 an injection system for delivering atomized fuel to a two stroke cycle internal combustion engine in which fuel in storage tank 12 is pumped by a low pressure transfer pump 14 to a distributor including a plurality of separate metering and pressure pumps 16, 16*a*, 16*b*, 16*c* through line 18 having filter 20 therein. Each of the pressure metering pumps 16, 16*a*, 16*b*, 16*c* is connected by high pressure fuel feed lines 24, 24*a*, 24*b*, 24*c* to an associated injector 26, 26*a*, 26*b* and 26*c* which are alike and are operatively mounted respectively in separate combustion chambers 28, 28*a*, 28*b* and 28*c*, each having a piston such as piston 30 operatively mounted for reciprocal movement therein during engine operation. The combustion occurs when the charge fuel/air mixture supplied to the chamber is compressed by the piston and is ignited by a conventional spark ignition system which includes a sparking plug diagrammatically illustrated at 34. As the piston moves down in expansion, an exhaust charge control exhausts the combusted and residual gases from the combustion chamber to an exhaust line 38.

FIG. 2 illustrates a preferred embodiment of this invention in the form of nozzle 38 of injectors 26. This injector nozzle has a tubular body 40 which terminates in a lower annular bottom wall 42 having a plurality of fuel feed passages 46 equally and arcuately spaced from one another and preferably at the same radial distance from the center of the bottom wall of 42.

The nozzle 38 has a washer-like, resilient diaphragm 50 of thin spring metal which is attached by annular electron beam weld 52 to the lower end of an adjustment nut 54 adjustably threaded to the nozzle. From the attachment to the adjustment nut 54 the diaphragm 50 extends radially inward to an annular inner edge 56 that defines a central orifice 58 which is sized to accomodate and cooperate with conically headed pintle 60 that is adjustably mounted in the bottom wall 42 of the nozzle by shank 62 threaded to the bottom wall 42. The head of the pintle is slotted so that length adjustment can be made with conventional tooling such as a Phillipstype screwdriver to adjust the fuel spray pattern of the atomized fuel when pulsed through the nozzle.

The sheet metal spring diaphragm or disk 50 is normally preloaded against the lower surface 62 of the bottom wall 42 to seal the fuel feed passages 46 from intrusion of gas from combustion chamber 28 during combustion. This prevents the accumulation of gases within the nozzle (sac volume) so that undesirable hydrocarbons are blocked from entry into the nozzle which would be subsequently exhausted into the combustion chamber during blowdown and exhausted through the exhaust line 38. Accordingly, with this invention, the sac volume is reduced to zero or to such a small amount that pollution control is optimized.

With this invention, the preload on the spring diaphragm 50 can be adjusted by threading the nut 54 upwardly or downwardly on the body of the nozzle to accordingly increase or decrease the spring load.

An upwardly extending annular ridge 66 intermediate the inner and outer peripheries of the diaphragm 50 enables the diaphragm to deflect primarily from the ridge without excessive stress in the thin-metal diaphragm material, especially at the centralized orifice or opening 58. The annular relief groove 68 formed in the lower side of bottom wall 42 is designed to accomodate the ridge 66 so that the inner surfaces of the diaphragm can close flat against the fuel feed passages 46 to effect their full closure during combustion. The annular chamber defined by the relief 68 and the diaphragm 50 is open to the interior of the injector by passage 70 in the bottom wall of the nozzle to prevent any entrapment of gases in this chamber.

In operation of cylinder 16 of the embodiment of FIGS. 1 to 3, the pump 16 pulses fuel to the injector 26 with relatively low pressures which vary with variable light engine loads. This pulsing action intermittently deflects the diaphragm 50 from its flattened and closed position to a deflected position which varies in accordance with engine load halfway between the full closed and fully deflected positions illustrated in the FIG. 2. Under such conditions, the fuel passages 46 are cracked and the pressurized fuel is ejected through the atomizing fuel passages and streams of atomized fuel are directed by the orifice 58 of the diaphragm against the conical head of the pintle 60. These streams of atomized spray are then deflected from the head of pintle 60 as indicated by the arrows 70 to provide the large cone spray pattern providing limited injection and stratified charge near spark plug 34 for optimized fuel efficiency for this light load engine operation. If the light engine load is progressively increased, the diaphragm 50 is progressively deflected to reflect the increased engine load with decreased spray angle and increased penetration so that engine operating efficiency matches the load. Under maximum engine load, the forces on the diaphragm 50 from the pulses from pump 16 may deflect the diaphragm to the fully open position shown by phantom lines in FIG. 2. Under these conditions, the orifice 58 of the deflected diaphragm 50 is moved well beyond the conical head of pintle 60 so that the fuel is injected through the fuel feed passages 46 and diaphragm orifice 58 to form the narrow angled conical charge 73 that penetrates deeply into combustion chamber 28. With chamber 28 homogeneously filled with the charge, fuel burn for high engine load performance and efficiency is optimized. After injection, the diaphragm 50 springs back to its closed position and, during combustion, the forces generated within the chamber 28 will push the diaphragm into even tighter sealing engagement with the annular lower surface 62 of bottom wall 42 so that gases from the combustion chamber 28 cannot enter the nozzle. Accordingly, sac chamber volume is reduced to approximately zero and there will be substantially no unburned hydrocarbons to flow from the nozzle on blowdown and exhausted through exhaust 38. Therefore, this invention provides an important advance in reduction of exhaust pollutants. If desired, the pintle may be adjusted to change the spray pattern or eliminated entirely with the varying cone angle being established by the orifice 58 and the amount of deflection of diaphragm 50.

FIGS. 4–6 illustrate another preferred embodiment of the invention which is similar to that of the embodiment of FIGS. 1–3 with the injector 126 and its nozzle 138 corresponding to the injector 26 and nozzle 38 of the embodiment of FIGS. 1–3. The lower end wall 142 of nozzle 138 has a centralized fuel feed passage 144 therethrough which is normally closed by a disk-like diaphragm 150 of thin spring sheet metal. This diaphragm has an annular arrangement of fuel delivery, orifices 152, which are located radially outboard of the central fuel feed passage 144 and are normally closed by the lower surface of the nozzle 138 as illustrated in FIG. 4. As in the first embodiment, the diaphragm 150 has a reinforcing ridge 156 adjacent to its outer edge and seated in annular relief 158 to allow diaphragm 150 to deflect without undue stress. The diaphragm 150 has a cylindrical upstanding collar 159 which may be secured to the lower end of the nozzle 138 such as by annular electron beam weld 160. When a fuel or fuel/air pulse resulting from light engine load reaches the diaphragm 150 by passing through the feed passage 144 in the nozzle, injection pressure causes the diaphragm 150 to slightly deflect outwardly as shown, for example, by FIG. 5. Diaphragm deflections of FIG. 5 and FIG. 7 are exaggerated to better illustrate their operations. The fuel charge flows radially outward from passage 144 to the plurality of openings 152 in the diaphragm and jets of atomized fuel are dispersed in a wide spray angle identified by numeral 161 and combustion chamber penetration is small. This wide angle stratified charge results from the fluid entering the orifices 152 with a large radial component. As engine load is increased, injection pressure and diaphragm pressure are increased, and the diaphragm deflection is accordingly increased. This reduces the radial velocity component $V_R$ as shown by the force diagram in FIG. 7A so that fuel spray angle is reduced and depth of injection is increased as illustrated by 163 in FIG. 7. This design accordingly provides the desired continuous variation of spray cone angle and depth that varies with engine load for optimized engine performance and efficiency.

The diaphragm 150 springs to a closed FIG. 4 position when not experiencing a pulsed charge of fuel from the injection system. On combustion, the fuel port is completely sealed so that combustion chamber gases cannot enter into the nozzle and with sac volume eliminated or reduced, substantial amounts of hydrocarbons cannot collect in the nozzle for subsequent discharge through the exhaust system on blowdown.

FIG. 8 illustrates another preferred embodiment of the invention in which a fuel injection nozzle 206 is employed in an injection system 208 which is supplied with fuel from a supply tank 210. This fuel is pumped from the tank 210 to a fuel injection controller 212 by a pump 214 operatively mounted in the supply line 216. The controller has a solenoid therein to control the timing and length of pulse of pressured fuel supplied to the injector nozzle 206 through line 218 in accordance with engine loads. A one-way check valve 220 opens in response to the timed pulses of fuel to transmit the fuel to the chamber 222 where it is mixed with air pumped from a compressor 226. The compressor 226 supplies pressure air to a controller 228 that includes solenoid control valving through conduit 230. The timed and pressurized pulses of air are supplied from controller 228 to annular mixing chamber 222 through line 232 through a one-way check valve 234. The fuel/air mixture in annular mixing chamber 222 is pulsed to a combustion chamber 238 of an internal combustion engine through an annular passage 240 formed in the lower end of the injector nozzle by the end wall 242 and the radial lower flange 244 of an adjustment nut 246. This nut is threadably adjustable onto the lower end of the nozzle by threads 248. This fuel feed passage is controlled by an annular, disk-like spring diaphragm 250. The diaphragm, secured to a lower peripheral edge of the nut by an annular weld 252. normally closes the injector fuel passage 240. An annular reinforcing rib 254 formed in the diaphragm allows diaphragm deflection without excessive stress of the thin metal diaphragm material especially at the central annular opening orifice 256. This orifice is of a diameter larger than the conical head of pintle 258 projecting axially from end wall 242 as will be further explained below.

At predetermined low engine load, the diaphragm 250 is slightly deflected so that feed passage 240 is cracked and the fuel/air mixture is directed onto the conical surface of the pintle 258. This mixture is deflected off of the conical surface of the pintle to provide the wide angle and stratified charge cone 260 for ignition by spark plug 262. When the narrow and deeper atomized spray of the charge is needed for improved combustion at maximum engine loads, the pulse load is so that the diaphragm opens to the dashed line position of FIG. 8 which is well beyond the end of the conical head of the pintle. Under these conditions, a narrow angled and deeper spray pattern 264 is injected past the pintle. This deep, narrow coned spray angle improves high load combustion performance as reported in connection with the other embodiments. The charge pattern and depth of charge between the low and maximum engine loads varies to match the engine loads as in the other embodiments with diaphragm deflection varying according to the fuel impulse forces thereon.

Also, the diaphragm 250 closes down during combustion to block feed passage 240 and the intrusion of unburned fuel into the chamber 222. With this blockage, sac volume is minimized so that there will be no substantial discharge of hydrocarbons from this nozzle into the combustion chamber on blowdown. Accordingly, with this invention, exhaust pollution is minimized.

The embodiment of FIG. 9 is similar to that of FIG. 8, but further provides improved control of the charge with a deeper and narrow cone spray angle for optimized injection at high engine loads. To this end, the injector 300 has pressurized air supply passage 306 leading to mixing chamber 308 through a one way ball check valve 310. Pulsed fuel is fed to mixing chamber 308 through line 312 and ball check valve 314 therein. The injector 300 terminates at its lower end in a generally cylindrical nozzle 316 having a lower end 318 with outer and inner fuel feed passages 320 and 322 arranged circularly and concentrically therein. The center of the lower end 318 is internally threaded at 324 for receiving the threaded shank of pintle 326. The pintle has a conical head and a central fuel feed cone 328 therethrough which leads from an inner pintle chamber 330 formed in the center of nozzle 316. Chamber 330 is in communication with the upper end of inner fuel feed passages 322. The lower ends of passages 322 are normally blocked by the inner upper surface of diaphragm 334 of thin wall spring steel. This diaphragm is generally like the diaphragm of the embodiments of FIGS. 2 and 8 with a central inner annular orifice 336 and with outer peripheral attachment to the bottom of an adjustment nut 337 by annular weld 338. The nut 336 threads onto the lower end of nozzle 316 to adjust the preload on the diaphragm 334 which fits against the flat bottom seat 340 of the lower end 318. By threadably advancing or retracting the nut, the spring preload on the diaphragm is accordingly varied. An annular ridge 344 is formed in the diaphragm as in the other embodiments for stress control to optimize diaphragm life.

At a predetermined light engine load in the FIG. 9 embodiment, the fuel or fuel/air charge will lift the diaphragm 334 to a given location such as midway between the nozzle seat 340 and the pintle cone during injection. By design, the open area between the diaphragm orifice 336 and the pintle cone is much greater than that of the feed passages 322 entering the pintle chamber 330 or the central orifice 328 through the pintle, and consequently, the primary injection flow will follow the path between the central orifice and the conical head of the pintle. This provides the wide angle low penetration stratified charge low load as indicated by arrows 348 with the spray deflecting from the coned head of the pintle for optimized low load engine performance. As the engine load is increased, the diaphragm deflects so that the central wall defining orifice 336 contacts the head of the pintle. With this sealing action, the charge is forced to flow from chamber 308 through the outer feed passages 320 into inner feed passages 322 and into pintle chamber 330, then from pintle chamber 330 through the central opening 328 in the pintle effecting a sharp decrease in the spray angle and increase in the depth of penetration as illustrated by the angle of deep penetration charge 350. Spray angle and depth of penetration varies with the diaphragm deflection ascending to engine loads for optimized engine performance and efficiency.

On closure of the diaphragm 334 during combustion, passages 322 will be blocked by the diaphragm and unburned hydrocarbons cannot be forced into mixing chamber 308. However, some of this hydrocarbon will enter chamber 330 by passage 328. By minimizing the volume of chamber 330, the subsequent exhaust of the hydrocarbons from this chamber 330 on blowdown when the combustion chamber pressure drops and opens to exhaust will be effectively minimized.

While a preferred embodiment of this invention has been shown and described, other modifications will be apparent to those skilled in the art. Accordingly, the scope of this invention is set forth in the following claims.

We claim:

1. A fuel injection nozzle for a combustion chamber of an internal combustion engine comprising a nozzle body with at least one fuel flow opening therethrough for feed fuel to the chamber, a resilient diaphragm normally sealing said opening and having orifice means therein for further atomizing and directing said pulses into said chamber, fastening means for fixing said diaphragm to said body so that diaphragm can deflect by a predetermined amount under low engine load operating conditions so that a wide angle cone of atomized fuel is injected into and generally at one end of said combustion chamber for the stratified charge thereof and deflect by an amount greater than said first amount of deflection under high engine load operating conditions so that a narrow spray cone of atomized fuel is injected in a deeper pattern into and throughout said combustion chamber for optimizing the charge thereof and fuel burns under said low and high load engine operating conditions.

2. The fuel injection nozzle of claim 1 wherein said diaphragm effects closure of said nozzle during the combustion of fuel within said combustion chamber to block entrance of combustion chamber gases into said nozzle.

3. A fuel injection nozzle for an internal combustion engine comprising a body with a nozzle end operatively located within a combustion chamber of the engine for delivering quantities of atomized fuel to said chamber, said chamber having a piston mounted for reciprocating movement therein, ignition means for igniting said fuel in said chamber, and gas exhaust means associated with said chamber, said nozzle end having at least one fuel flow opening therethrough so that fuel fed to said nozzle can be dispensed into said combustion chamber, a flexible diaphragm supported by said nozzle for yieldably blocking said opening so that gases from said combustion chamber are blocked from intrusion into said nozzle from compression in the combustion chamber to force the diaphragm tightly against the nozzle body for improved sealing of said opening, said flexible diaphragm being responsive to low engine loads and proportional pressurized injections by deflecting away from that fuel flow opening means to provide a wide angle spray pattern and responsive to higher engine loads with proportionally increased injection pressure by moving away from said fuel flow opening means so that a proportionally narrow angle and deeper spray pattern into said combustion chamber is provided.

4. A fuel injector nozzle for an internal combustion engine having a combustion chamber and a piston mounted for reciprocating movement therein and ignition means for igniting said pulses of fuel fed to said combustion chamber and gas exhaust means for exhausting gas from said combustion chamber, said nozzle end having at least one fuel flow opening therethrough so that fuel fed thereto can be dispensed into said combustion chamber in general geometric atomized spray patterns, a flexible diaphragm supported by said injector for yieldably blocking said opening so that gases from said combustion chamber are blocked from being forced into said injector during combustion of gases within said combustion chamber and for closing tightly against said nozzle body to improve the sealing of said opening, said flexible diaphragm being responsive to low engine load and proportional injection pressures by moving away from said fuel flow opening means by a low angle to provide a generally wide angle spray pattern and from said fuel flow opening means in response to high engine loads by a greater angle so that a narrow angle spray pattern is generated that penetrates deeper into said combustion chamber for optimized combustion under high engine load conditions.

5. The injector nozzle of claim 4 wherein a pintle is provided at the end of said nozzle and said diaphragm moves into contact against said pintle, said pintle having an orifice therethrough for directing a low angle atomized spray of fuel deeper into said combustion chamber for improved combustion at high load conditions.

6. A fuel injector nozzle for an internal combustion engine having a combustion chamber and a piston mounted for reciprocating movement therein and ignition means for igniting said pulses of fuel fed to said combustion chamber and gas exhaust means for exhausting gas from said combustion chamber, said nozzle end having at least one fuel flow opening means therethrough so that fuel fed thereto can be dispensed into said combustion chamber in general geometric atomized spray patterns, a flexible diaphragm supported by said nozzle for yieldably blocking said opening so that gases from said combustion chamber are blocked from being forced into said injector during combustion of gases within said combustion chamber and for closing tightly against said nozzle body to improve the sealing of said opening, said flexible diaphragm being a disc of thin wall spring metal having a fuel flow control orifice therethrough, said orifice being radially inward of said fuel flow opening, said diaphragm being responsive to low engine load and proportional injection pressures by moving away from said fuel flow opening means by a low angle to provide a generally wide angle spray pattern and from said fuel flow opening means in response to high engine loads by a greater angle so that a narrow angle spray pattern is generated that penetrates deeper into said combustion chamber for optimized combustion under high engine load conditions.

7. The injector nozzle of claim 6 wherein a pintle having a fuel directing head is provided at the end of said nozzle and said diaphragm fuel flow control orifice directs a spray pattern of atomized fuel onto said head for redirection in a different spray pattern into said combustion chamber for improved combustion at high load conditions.

* * * * *